US007966966B2

(12) United States Patent
Ito

(10) Patent No.: US 7,966,966 B2
(45) Date of Patent: Jun. 28, 2011

(54) VACUUM HIGH PRESSURE FILLING EQUIPMENT

(75) Inventor: Hidetoshi Ito, Nagano (JP)

(73) Assignee: Mikado Technos Co., Ltd., Nagano (JP)

( * ) Notice: Subject to any disclaimer, the term of this patent is extended or adjusted under 35 U.S.C. 154(b) by 500 days.

(21) Appl. No.: 11/994,323

(22) PCT Filed: May 24, 2006

(86) PCT No.: PCT/JP2006/310387

§ 371 (c)(1),
(2), (4) Date: Dec. 28, 2007

(87) PCT Pub. No.: WO2007/013212

PCT Pub. Date: Feb. 1, 2007

(65) Prior Publication Data

US 2009/0084313 A1 Apr. 2, 2009

(30) Foreign Application Priority Data

Jul. 29, 2005 (JP) ..... 2005-219941

(51) Int. Cl.
*C23C 14/00* (2006.01)

(52) U.S. Cl. ..... 118/50; 118/423; 118/450

(58) Field of Classification Search ..... 118/423, 118/450, 50

See application file for complete search history.

(56) References Cited

U.S. PATENT DOCUMENTS 3,322,566 A * 5/1967 Bright ..... 427/294
3,440,708 A * 4/1969 Zoiss et al. ..... 29/419.1
4,311,735 A * 1/1982 Young ..... 427/295
4,620,991 A * 11/1986 Young ..... 427/294
5,022,343 A * 6/1991 Fujikawa et al. ..... 118/47

(Continued)

FOREIGN PATENT DOCUMENTS

JP 63-66136 5/1988

(Continued)

*Primary Examiner* — Parviz Hassanzadeh
*Assistant Examiner* — Albert Hilton
(74) *Attorney, Agent, or Firm* — J.C. Patents

(57) ABSTRACT

The present invention proposes a vacuum/high pressure filling apparatus which can improve the filling rate and shorten the impregnating time period in immersing a porous workpiece into a filling liquid. The vacuum/high pressure filling apparatus includes: an openable and closable hermetic partition chamber unit constituted by two upper and lower split partition wall unit portions, a partition chamber unit opening and closing mechanism to open and close the partition chamber unit, a vacuum suction opening and a pressurizing opening provided for the partition chamber unit, a liquid vessel arranged in the partition chamber unit to receive a filling liquid, a holder arranged, in the partition chamber unit, for the porous workpiece, an elevator unit to move the filling liquid in the liquid vessel and the porous workpiece relative to each other inside the partition chamber unit so as to immerse the porous workpiece into the filling liquid in the liquid vessel and pull up the workpiece from the filling liquid. When the partition chamber unit opening and closing mechanism brings the two upper and lower split partition wall unit portions into hermetic contact with each other, the partition chamber unit is closed and sealed. When the partition chamber opening and closing mechanism spaces the two upper and lower split partition wall unit portions from each other, the partition chamber unit is opened. By using the vacuum/high pressure filling apparatus according to the present invention, composite materials such as lubricant-impregnated metals, thermosetting resin-impregnated cast metals, etc. can be obtained.

15 Claims, 8 Drawing Sheets

U.S. PATENT DOCUMENTS

| | | | | |
|---|---|---|---|---|
| 6,740,163 | B1 * | 5/2004 | Curtiss et al. | 118/423 |
| 7,195,476 | B2 | 3/2007 | Ito | 425/388 |
| 2004/0241447 | A1 * | 12/2004 | Fukushima | 428/408 |

FOREIGN PATENT DOCUMENTS

| | | |
|---|---|---|
| JP | 63-69541 | 5/1988 |
| JP | 63-69542 | 5/1988 |
| JP | 8-39747 | 2/1996 |
| JP | 2002096199 | 4/2002 |
| JP | 2002354988 | 12/2002 |
| JP | 2003339328 | 12/2003 |
| JP | 2004330291 | 11/2004 |
| JP | 2005024617 | 1/2005 |

* cited by examiner

VACUUM HIGH PRESSURE FILLING EQUIPMENT

TECHNICAL FIELD

The present invention relates to vacuum/high pressure filling apparatuses which inside a hermetic partition chamber unit, forcedly deaerates under vacuum pores or holes of a workpieces to be processed, which is finely porous or has through-pores or through-holes or blind pores or holes (bottomed pores or holes) (hereinafter referred to as "porous workpiece" in this specification), immerses the workpiece in a filling material such as a filling liquid or fluid or a powder-mixed liquid, forcedly fills the filling material into the workpiece under pressure with air or a gas, and thereby obtains a composite material having high gastightness and functionality. Further, the present invention relates to a vacuum/high pressure filling apparatus which inside a hermetic partition chamber unit, forcedly deaerates under vacuum a fluid material to be processed, and mixes a mixed gas into the fluid material in an atmosphere filled with the mixed gas at a high pressure. Furthermore, the present invention relates to a vacuum/high pressure filling apparatus which inside a hermetic partition chamber unit, forcedly deaerates under vacuum a porous workpiece to be processed, feeds a melt of a metal to the workpiece, fills a hole of the workpiece at a high pressure, and thereby obtains a composite material or the like having high gastightness and functionality.

BACKGROUND ART

As the conventionally known vacuum filling apparatuses of the above types, there has been formerly used one in which a container containing plural porous workpieces to be processes is put into an impregnating tank having a filling liquid therein, the impregnating tank is closely sealed by tightening its lid, the interior of the impregnating tank is deaerated under reduced pressure while the workpieces are kept immersed, the vacuum state is maintained for a prescribed time period, the workpiece container having the porous workpieces therein is taken out of the interior of the impregnating tank through opening its lid after the tank is returned to the atmospheric pressure. Moreover, a vacuum impregnating apparatus is known, which comprises an impregnating tank, a storage tank, an open air intake means, a vacuum pump, etc. and impregnates a liquid component or the like into a food dried under reduced pressure inside the impregnating tank. In addition, such a vacuum impregnating apparatus is known, in which a food is put in an impregnating tank, a lid of the impregnating tank is closed to hermetically seal the tank, the food is dried under reduced pressure, while a warming gas is introduced so that the food may not be frozen inside the impregnating tank, afterwards a liquid component or a gas component inside the storage tank is introduced into the impregnating tank, the interior of the impregnating tank is returned to the atmospheric pressure or pressurized after the pressure-reduced state is maintained for a prescribed time, the filling liquid is once extracted or lowered in level, the lid of the impregnating tank is opened, and the finished food is taken out of the tank. For instance, see JP2002-354988A, JP 2003-339328A, and JP2003-339328A.

However, the above conventional first vacuum filling apparatus has drawbacks that the filling rate is low and it takes a long time to perform the vacuum impregnation. Moreover, the above conventional second vacuum filling apparatus improves the filling rate, but the filler fluid component or the like needs to be put in and taken out of the impregnating tank.

So, it takes an extra equipment and time. Though it is common to both the vacuum filling apparatuses, the lid fixed to the impregnating tank with a hinge or the like is opened and closed through loosing and tightening bolts or the like every one filling work, and the porous workpiece or food is moved into or out from the impregnating tank. Accordingly, it was difficult to shorten the working time.

DISCLOSURE OF THE INVENTION

Problems to be Solved by the Invention

A first object of the present invention is to provide a vacuum/high pressure filling apparatus which can increase a filling rate and shorten an impregnating time period and which thus can shorten the working time period and the vacuum/high pressure filling time by making the movement of the a filling liquid from a filling liquid vessel unnecessary, through employing a construction in which after a porous workpiece to be processed is deaerated inside a hermetic partition chamber unit under vacuum, the workpiece is immersed in the filling liquid of the liquid vessel inside the hermetic partition chamber unit, while the deaerated state is being kept; the filling material is forcedly filled into fine pores of the porous workpiece through applying a high pressure to the filing liquid in the immersing state.

A second object of the present invention is to provide a vacuum/high pressure filling apparatus in which after a fluid material to be processed, placed in a container, is deaerated inside a hermetic partition chamber unit while being stirred under vacuum, the interior of the vacuum partition chamber unit is replaced and made high pressure with another mixing gas, and this gas is mixed into the fluid material or the gas is mixed into and chemically reacted with the fluid material by stirring the material in this high pressure gas.

A third object of the present invention is to provide a vacuum/high pressure filling apparatus in which after a porous workpiece to be processed is held by a workpiece holding unit arranged inside a partition chamber unit and a porous workpiece to be processed is deaerated by forming a vacuum in the interior of the partition chamber unit, an appropriate amount of a melt is penetrated into fine pores or cavities of the porous workpiece; and an inert gas is introduced into the partition chamber unit and a high pressure is applied onto an upper face of the penetrated melt, so that the workpiece is filled and sealed or finely filled with the melt by penetrating the melt up to deep portions of the fine pores or cavities under high pressure in a non-oxidizing state.

Measures to Solving the Problems (1) In order to attain the first object of the present invention, the first aspect of the present invention is to provide a vacuum/high pressure filling apparatus comprising: an openable and closable hermetic partition chamber unit constituted by two upper and lower split partition chamber unit portions, a partition chamber unit opening and closing mechanism adapted to open and hermetically close the partition wall unit, a vacuum suction opening provided for the partition chamber unit to evacuate the partition chamber unit to vacuum, a pressurizing opening provided for the partition chamber unit to set the interior of the partition chamber unit to a high pressure state, a liquid vessel arranged in the partition chamber unit and adapted to receive a filling liquid, a holder arranged in the partition chamber unit for a porous workpiece to be processed, and an elevator unit adapted to move the filling liquid in the liquid vessel and the porous workpiece holder relative to each other inside the partition chamber unit to immerse the porous workpiece into the filling liquid in the liquid vessel and pulls up the workpiece from the filling liquid, wherein when the partition chamber unit opening and closing mechanism brings the two upper and lower split partition wall unit portions into hermetic contact with each other, the partition chamber unit is closed and sealed, whereas when the partition chamber opening and closing mechanism spaces the two upper and lower split partition wall unit portions from each other, the partition chamber unit is opened.

According to the first aspect of the present invention, which adopts the above construction, the partition wall unit opening/closing mechanism can hermetically close the partition wall unit readily and in a short time, and the porous workpiece to be processed can be easily transferred into the partition chamber unit and the processed workpiece can be easily transferred out of the partition chamber unit through between the spaced split partition chamber unit portions. In addition, since the porous workpiece is immersed into the filling liquid in the liquid vessel inside the hermetic partition wall unit after the pores of the workpiece are deaerated in vacuum inside the hermetic partition wall unit, it is possible to obtain a highly hermetic and functional composite material by forcedly filling the filling liquid in the pores of the porous workpiece under application of high pressure. Consequently, the filing rate can be improved, the vacuum-reducing time period and the impregnating time period can be shortened and further the movement of the filling liquid can be made unnecessary, thereby largely shortening the working time period. Furthermore, the filling apparatus is advantageous in withstanding the higher pressure, through the adoption of the construction that the openable/closable hermetic partition chamber unit is constituted by the two upper and lower split partition wall unit portions, and the partition chamber unit opening and closing mechanism brings these two upper and lower split partition wall unit portions into a hermetic contact with each other to hermetically close the partition chamber unit, whereas the partition chamber unit opening and closing mechanism separates the two upper and lower split partition wall unit portions from each other to open the partition chamber unit.

(2) In order to attain the above second object, the second aspect of the present invention provides the vacuum/high pressure filling apparatus comprises: an openable and closable hermetic partition chamber unit constituted by two upper and lower split partition wall unit portions, a partition chamber unit opening and closing mechanism adapted to open and hermetically close the partition wall unit, a vacuum suction opening provided for the partition chamber unit to evacuate the partition chamber unit to vacuum, a pressurizing opening provided for the partition chamber unit to set the interior of the partition chamber unit to a high pressure state with a mixing gas, a liquid vessel arranged in the partition chamber unit and adapted to receive a fluid material to be treated, and a stirrer arranged in the partition chamber unit and adapted to stir the fluid material in the liquid vessel and mix a mixing gas into the fluid material, wherein when the partition chamber unit opening and closing mechanism brings the two upper and lower split partition wall unit portions into hermetic contact with each other, the partition chamber unit is closed and sealed, whereas when the partition chamber opening and closing mechanism separates the two upper and lower split partition wall unit portions from each other, the partition chamber unit is opened.

According to the second aspect of the present invention, which adopts the above construction, the partition wall unit opening/closing mechanism can hermetically close the partition wall unit readily and in a short time, and the fluid material to be processed can be easily transferred into the partition chamber unit and the processed fluid material can be easily transferred out of the partition chamber unit through between the spaced split partition chamber unit portions. Furthermore, after the fluid material to be processed is deaerated in vacuum inside the hermetic partition wall unit, the mixing gas is filled in the partition chamber unit at high pressure, and the mixed gas is forcedly mixed into the fluid material, while the fluid material is being stirred in the liquid vessel. Thereby, the mixed gas can be mixed into the fluid material effectively and in a shorter time period. Moreover, if the mixed gas reacts with the material, the reacting efficiency can be improved and the reaction time period can be shortened.

According to the second aspect of the present invention, it can be constructed that the stirrer comprises a stirring rotary element, and the stirrer is arranged such that the stirring rotary element is positioned in an upper portion of the partition chamber unit, said filling apparatus comprises an elevator adapted to vertically move the stirring rotary element and the liquid vessel for the fluid material relative to each other to immerse the stirring rotary element into the fluid material in the liquid vessel and pull up the stirring rotary element from the fluid material.

(3) In order to attain the above third object, the third aspect of the present invention is to provide a vacuum/high pressure filling apparatus, comprising: an openable and closable hermetic partition chamber unit constituted by two upper and lower split partition chamber unit portions, a partition chamber unit opening and closing mechanism adapted to open and hermetically close the partition wall unit, a vacuum suction opening provided for the partition chamber unit to evacuate the partition chamber unit to vacuum, a pressurizing opening provided for the partition chamber unit to set the interior of the partition chamber unit to a high pressure state with an inert gas, a porous workpiece container arranged in the partition chamber unit, adapted to receive a porous workpiece to be processed and equipped with a heating mechanism and a cooling mechanism, and a melting furnace adapted to feed a melt to the porous workpiece received in the container inside the partition chamber unit, the melting furnace being equipped with a heating function.

According to the third aspect of the present invention, which adopts the above construction, the partition wall unit opening/closing mechanism can hermetically close the partition wall unit portions readily and in a short time and the porous workpiece to be processed can be readily transferred into the partition chamber unit and the processed workpiece can be readily transferred out of the partition chamber unit through between the spaced split partition chamber unit portions. Moreover, the melt is fed to the porous workpiece to be processed from the melting furnace with the heating heater after the workpiece is deaerated in vacuum inside the hermetic chamber unit, and the interior of the partition wall unit is set at high pressure with the inert gas, so that the pores or cavities of the porous workpiece can be finely filled in the non-oxidizing state, and the filling rate can be improved, and the vacuum time period and the impregnating time period can be shortened.

According to the first aspect of the present invention, a heating unit, a vibrating unit, an oscillating unit or a stirring rotary element can be provided for heating, vibrating, oscillating or stirring the filling liquid inside the liquid vessel. The filling liquid can be more effectively filled in the porous workpiece by heating, vibrating or oscillating in the state that the workpiece is immersed in the filling liquid. When the heating unit is provided, the material which is solid at ordinary temperature but is liquefied or fluidized by heating can be used as the filling liquid. Heating is also effective to keep the fluidity (viscosity) of the filling liquid constant.

According to the second aspect of the present invention, a heating unit, a cooling unit, a vibrating unit, an oscillating unit or an ultraviolet irradiating unit can be further provided for heating, cooling, vibrating, oscillating or ultraviolet ray-irradiating the fluid material inside the liquid vessel. According to the second aspect of the present invention, when the fluid material is heated, cooled, vibrated, oscillated, or illuminated with ultraviolet rays in the state that the stirrer is immersed in the fluid material and the material is stirred, it can effectively mix and fill the mixed gas and promote a chemical reaction. If the ultraviolet light is irradiated, the material can be simultaneously sterilized. Furthermore, when the heating unit is provided, a material which is solid at ordinary temperature but is fluidized by heating can be used as the fluid material to be processed. Heating is also useful from the standpoint of the promotion of the reaction. The cooling unit is effective when a reaction heat needs to be absorbed.

According to the third aspect of the present invention, a heating unit, a cooling unit, a vibrating unit or an oscillating unit can be provided for heating, cooling, vibrating or oscillating, during supplying the melt, the porous workpiece to be processed. A third aspect of the present invention can finely fill the melt in the porous workpiece well over every portion in a shorter time and more effectively by heating, vibrating or oscillating the workpiece during feeding the melt. Heating raises the temperature of the porous workpiece, and can prevent the melt from being solidified at an early stage. Further, the cooling unit is useful for solidifying the melt without oxidization.

Furthermore, according to the first, second and third aspects of the present invention, the partition chamber unit structure can be constructed as follows.

(A) The partition chamber unit comprises a base table on which is placed the liquid vessel or the container for the workpiece or material to be processed, a lower fixed frame arranged on the base table, surrounding the liquid vessel or the workpiece or material container, while spaced away from the liquid vessel workpiece container, an upper frame fixed to a lower face of an attachment plate installed above the base table, a hermetically sliding mechanism adapted to ensure gastightness between the lower fixed frame and the upper frame, and a sliding drive mechanism adapted to drive the hermetically sliding mechanism, wherein the partition chamber unit can be formed by the base table, the lower fixed frame, the upper frame, the attachment plate and the hermetically sliding mechanism through driving the hermitically sliding mechanism.

(B) The upper frame is a movable upper frame, the hermetically sliding mechanism is constituted by a hermetically sliding portion provided at an upper end portion of the lower fixed frame and a hermetically sliding portion provided at a corresponding lower end portion of the movable upper frame, the hermetically sliding portion of the upper end portion of the lower fixed frame hermetically slides with that of the lower end portion of the movable upper frame, so that gastightness is secured between the fixed lower frame and the upper moving frame, and the partition chamber unit can be formed by the lower fixed frame, the upper movable frame, the base table and the attachment plate.

(C) The hermetically sliding mechanism is a sliding frame vertically slidably fitted around an outer peripheral face of either the lower fixed frame or the upper frame, the sliding drive mechanism is a sliding drive mechanism adapted to vertically slidably move the sliding frame, and the sliding frame is slidably moved by the sliding drive mechanism, wherein gastightness is secured among the lower fixed frame, the sliding frame and the upper frame, and the partition chamber unit can be formed by the lower fixed frame, the sliding frame, the upper frame, the base table and the attachment plate.

In (A), (B) and (C), the vacuum partition chamber unit can be simply and assuredly readily opened and closed, and application of high pressure inside the vacuum partition chamber unit can be more certainly endured.

According to the first, second and third aspects of the present invention, a slide table can be further provided to transfer the holder or the container for the porous workpiece to be processed into or out of the machine body. The porous workpiece or fluid material to be processed can be easily set to the holder or the container and the processed workpiece or material can be easily taken out thereof.

In the following, methods for using the vacuum/high pressure filling apparatuses will be briefly described.

In order to attain the first object of the present invention, any of the vacuum/high pressure filling apparatuses according to the first aspect of the present invention is used, the partition chamber unit is opened, the porous workpiece is set at the porous workpiece holder inside the partition chamber unit, and then the partition chamber unit is closed. Then, holes of the porous workpiece are deaerated by evacuating the interior of the partition chamber unit to vacuum, the deaerated porous workpiece is immersed in the filling liquid inside the liquid vessel through driving the elevator inside the partition chamber unit, and the filling liquid is filled into the above pores by applying high pressure upon the filling liquid for a given time period during immersing. Thereafter, the elevator is driven to pull up the porous workpiece from the filling liquid, the partition chamber unit is opened to be returned to the atmospheric pressure, and the workpiece is taken out of the partition chamber unit.

In order to attain the second object of the present invention, any of the vacuum/high pressure filling apparatuses according to the second aspect of the present invention is used, the partition chamber unit is opened, the fluid material vessel containing the fluid material to be processed is arranged inside the partition chamber unit, and then the partition chamber unit is closed. Thereafter, air is removed from the fluid material by reducing the partition chamber unit to vacuum. Then, the mixing gas is filled in the vacuum partition chamber at high pressure, the stirring unit is operated for a given time period, the mixing gas is mixed into the deaerated fluid material under stirring, and then stirring is stopped. Thereafter, the partition chamber unit is opened to be returned to the atmospheric pressure, and the fluid material fluid vessel with the fluid material is taken out from the partition chamber unit.

In order to attain the second object of the present invention, any of the vacuum/high pressure filling apparatuses according to the second aspect of the present invention is used, the partition chamber unit is opened, the fluid material vessel containing the fluid material to be processed is arranged inside the partition chamber unit, and then the partition chamber unit is closed. While the ultraviolet rays are irradiated or being irradiated, the partition chamber unit is reduced to vacuum, thereby forming the sterilized partition chamber. Thereafter, air is removed from the fluid material, and then the mixing gas is filled in the vacuum partition chamber at high pressure, the stirring unit is operated for a given time period to stir the deaerated fluid material, the mixing gas is mixed into the fluid material and is sterilized, and then stirring is stopped. Thereafter, the partition chamber unit is opened to be returned to the atmospheric pressure, and the fluid material container containing the fluid material is taken out of the partition chamber unit.

In order to attain the third object of the present invention, any of the vacuum/high pressure filling apparatuses according to the third aspect of the present invention is used, the partition chamber unit is opened, the porous workpiece to be processed is placed in the workpiece container and heated, and the partition chamber unit is closed. Thereafter, the pressure-proof vacuum partition chamber unit is formed by evacuating the partition chamber unit to vacuum, and thereby the pores or cavities existing in the porous workpieces inside the workpiece container, and the pores or cavities are filled with the metal melt in this deaerated state by feeding the melt from the melting furnace having the heating function. Thereafter, the inert gas is led into the partition chamber unit to set the interior of the partition chamber unit to a highly pressurized state, thereby applying high pressure upon the fed melt. Then, the partition chamber unit is opened to be returned to the atmospheric pressure, and the processed porous workpiece inside the workpiece container is taken out of the partition chamber unit. In this method, if the porous workpiece has a face communicating with that face to which the melt is fed, the former face is so sealed that the melt fed to the latter may be sufficiently filled into the pores.

BEST MODE TO CARRY OUT THE INVENTION

Figure 1:
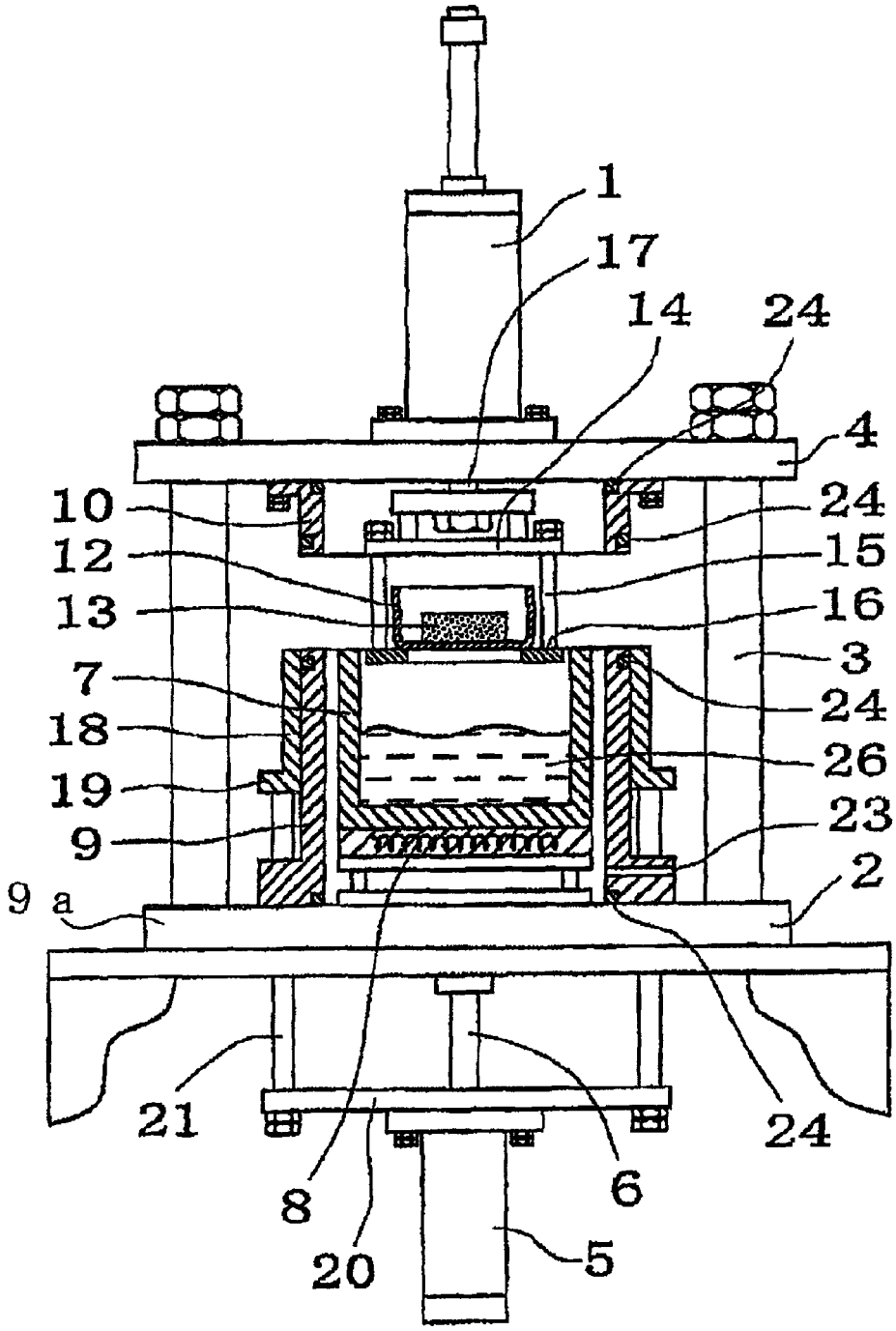
FIG. 1 is a front view schematically showing a first embodiment of the vacuum/high pressure filling apparatus according to the present invention.

First, preferred embodiments of the present invention will be explained.

(1) Openable and Closable Hermetic Partition Chamber Unit

The openable and closable hermetic chamber unit means a hermetic pressure-proof partition chamber unit which comprises two upper and lower split partition wall unit portions and which allow a workpiece to be put into and taken out of the workpiece container in an opened state, while in a closed state, the partition chamber unit can be depressurized to vacuum through a vacuum suction opening and set to high pressure by introducing a high pressure gas through a pressurizing opening.

(2) Partition Chamber Opening and Closing Mechanism

A cylinder is used as the partition chamber unit opening and closing mechanism. The partition chamber unit is closed by bringing the two split partition chamber unit portions into hermetic contact with each other by means of the cylinder, and the partition chamber unit can be opened by spacing the split partition chamber unit portions. According to the present invention, the partition chamber unit can be hermetically closed or opened very simply and in a short time by means of the partition chamber unit and the partition chamber opening and closing mechanism.

(3) Holder for the Workpiece to be Processed

As the workpiece holder to be used in the present invention, any one can be used, so long as it can immerse and pull up the workpiece such as the porous workpiece with respect to the filling liquid inside the liquid vessel in order to perform a given processing. For instance, use may be made of various kinds of holders adapted to hang the workpiece, such as a placing plate capable of stably install the workpiece thereon, a container for the workpiece to be processed, etc. In order to make the liquid enter, the workpiece holder such as the placing plate and the workpiece container is preferably constituted by a porous material such as a metallic material formed with holes or grooves or punched metals. Further, although ordinarily plural porous workpieces to be processed may be simultaneously hanged by the workpiece holder or piled one upon another in it, they may be arranged in a single row or plural rows.

(4) Liquid Vessel for the Filling Liquid

The liquid vessel for the filling liquid may be one which is installed fixedly inside the partition chamber unit, or may be one which can be installed and removed at need in the state that the partition chamber unit is opened.

(5) Elevator Unit

Any elevator unit is acceptable, so long as it can move at least either one of the workpiece holder and the liquid vessel for the filling liquid toward directions in which they approach and space from each other so that the workpiece to be processed may be immersed into and pulled up from the filling liquid inside the liquid vessel. For instance, it may be constructed that the liquid vessel for the workpiece is fixed at a predetermined position, the workpiece is immersed into the filling liquid inside the liquid vessel by ascending and descending the workpiece holder, and then the workpiece is pulled up, thereby performing the predetermined processing. Alternatively, it may be constructed that the workpiece holder is fixed at a predetermined position, the workpiece is immersed into the filling liquid inside the liquid vessel by ascending and descending the liquid vessel for the workpiece, and then the workpiece is pulled up, thereby performing the predetermined processing.

(6) Stirrer

As the stirrer used in the present invention, any stirrer suffices, so long as it can stir the filling liquid under high pressure and thus mix the mixing gas into the filling liquid, thereby performing a predetermined processing. For instance, depending upon the kind of the liquid, an electromagnetic stirrer can be used, which electromagnetically rotates the filling liquid inside the liquid vessel from the outside. Alternatively, an electromagnetic stirrer can be used, in which a magnetic stirrer element is disposed in the filling liquid inside the liquid vessel, and the stirring element is rotated magnetically from the outside. Or, it may be that a stirrer element of the stirrer is disposed in an upper portion of the liquid vessel, and the stirrer element of the stirrer is immersed in and pulled up from the filling liquid inside the liquid vessel by an elevator, thereby enabling the filling liquid to be stirred at a proper time. The above explanation is applied to the elevator device.

(7) Melting Furnace

The melting furnace used in the present invention is a furnace which receives a melt produced at other place, keeps its melted state and feeds the melt to the workpiece to be processed, or a melting furnace which melts a starting material therein. The melting furnace is provided with an appropriate heater to keep the melted state. The melting furnace is constructed to communicate with the partition chamber unit and finely fill the melt in the workpiece by means of an appropriate opening and closing unit such as a shutter or a valve for the partition chamber unit.

(8) Vacuum Suction Opening, Pressurizing Opening

The vacuum suction opening and the pressurizing opening are connected to a vacuum device and a gas compression feeder, respectively. In this case, it may be that one opening is commonly used for the vacuum suction opening and the pressurizing opening, and that opening is selectively connected to the vacuum device or the gas compression feeder by switching as needed. Although depending upon the kind, the size, etc. of the desired product, it may be that for instance, the vacuum suction time period is 1 to 5 minutes, the penetration or impregnation pressure is 1.0 MPa to 3.0 MPa, and the penetration or impregnation time period is 5 to 15 minutes.

(9) Workpiece and Material to be Processed

As the workpiece and the material to be processed in the present invention, mention is made of composite materials of such as ceramics, metals, reinforcing fibers, etc., porous workpieces of such as metals, resins, cast metals, ceramics, etc., workpieces having through-holes or pores, blind holes or pores or closed cell type or open cell type structures (hereinafter referred to also as porous workpieces to be processed and workpieces having holes or pores to be processed). For instance, mention may be made of ceramic porous bodies, powder-molded porous metal bodies, metal-cast bodies, sintered metallic bodies, oilless metallic workpieces, foamed resin-molded bodies, FRP resin molded bodies, etc. Further, according to the present invention, mention is made of various foods such as vegetables including leafy vegetables, root vegetables, mushroom, etc, fruits, cereals, beans, meats, fishes, skins, eggs, egg shells, bones, paste products, processed products thereof, livestock feeds, etc. When being immersed, it may be that those foods are raw, appropriately cut, appropriately dried or heated, or frozen.

(10) Filling Liquid, Melt

As the filling liquid, mention is made of oils, mixed liquids of chemicals such as antibacterial agents, macromolecular polymers, resins, nanocarbons, metal powders (including magnetic metal powders), powdery optical catalysts, etc., for example. As mixing media, use may be made of water, oils, silicone resins, fluorine resins, thermosetting organic solvents including methacrylate-based resins, etc.

As the liquid component to be impregnated into foods, use may be made of any of liquids, solutions, slurry liquids, dispersion liquids, etc., which are liquids to be readily handled in impregnation. As such liquid components, for example, the following components can be used as needed in the state that they are dispersed or solved in liquids. Further, they may be used singly or in appropriately mixed states.

Mention may be made of liquids such as water, alcohols, edible oils, chelate liquids, etc.; fermented seasonings such as soy sauce, soy bean pastes, etc.; food extracts such as fruit juices, meat juices, etc.; beverages such as alcohols, juices, teas, etc.;

inorganic salts such as sodium chloride, potassium chloride, calcium chloride, magnesium chloride, iron chloride, etc.; indispensable inorganic element such as iodine; sweeteners such as saccharose, fructose, glucose, starch syrup, honey, maple syrup, other natural sweeteners, artificial sweeteners, etc.; and sour agents such as various vinegar, acetic acid, phosphoric acid, lactic acid, malic acid, citric acid, tartaric acids, gluconic acids, etc. The liquid components to be used in the present embodiments have only to be liquid during impregnation, and those which are solid materials at normal temperatures, such as beef fat, butter, and chocolates can be used.

As metals forming melts, metals having low melting points such as tin, zinc, lead, cadmium, etc. and alloys thereof can be enumerated.

(11) Heating Unit, Cooling Unit, Vibrating Unit, Stirrer, Ultraviolet Ray Irradiating Unit When it is preferable to heat the filing liquid in the liquid vessel during processing, the heating unit is provided. When cooling is necessary, the cooling unit is provided. The vibrating unit for vibrating or oscillating the filing liquid can be provided to secure the uniformity of the filing liquid. Further, the stirrer can be provided to stir the filling liquid in order to secure the uniformity of the filling liquid. Furthermore, the ultraviolet ray irradiating unit can be provided to perform sterilization during the deaerating and pressuring steps during processing.

(12) Fluid Materials to be Processed, Mixing Gas

When water is used as the fluid material, oxygen is mixed into water as the mixing gas to obtain high-concentration oxygen water. When high concentration hydrogen-reduced water is to be obtained, hydrogen is mixed into water. In order to obtain antioxidant water, nitrogen or argon is mixed into water as the mixing gas.

The mixing gas is appropriately selected depending upon the kind of the fluid material to be processed, a desired reaction, etc. For example, when the fluid material to be processed is to be impregnated with an organic EL solution or the like, nitrogen gas is used as a pressurizing mixing gas to prevent a chemical reaction with the atmosphere, and in the case of impregnation of foods, nitrogen gas or argon gas is used as the pressurizing mixing gas.

(13) Processed Products

Composite materials can be obtained by penetrating or impregnating the filling liquid or the melt into the porous workpieces and the workpieces having pores according to the present invention. Thereby, the products can be imparted with desired physical properties such as electric conductivity, insulation property, magnetizable property, shielding property, lubricity, antibiotic property, corrosion resistance, rigidity, sealingness, and earthquake resistance, etc.

As the processed products, copper or iron powdery sintered bearings and oilless metals impregnated with lubricating oils, cast metal products impregnated with thermoset organic solvents, electroless plated or anti-rust treated cast metal products, sintered products, fire safety valves filled with low-melting point metals for high pressure gas cylinders, transformers and motor coils impregnated and fixed with varnish. Gases need to be discharged through the pores in the case of the safety valve for the high pressure gas cylinder particularly on fire. Since the melt can be filled in the pores in the non-oxidizing state, excellent safety valve can be obtained for the high pressure gas cylinder.

EMBODIMENTS OF THE INVENTION

First Embodiment

Figure 2:
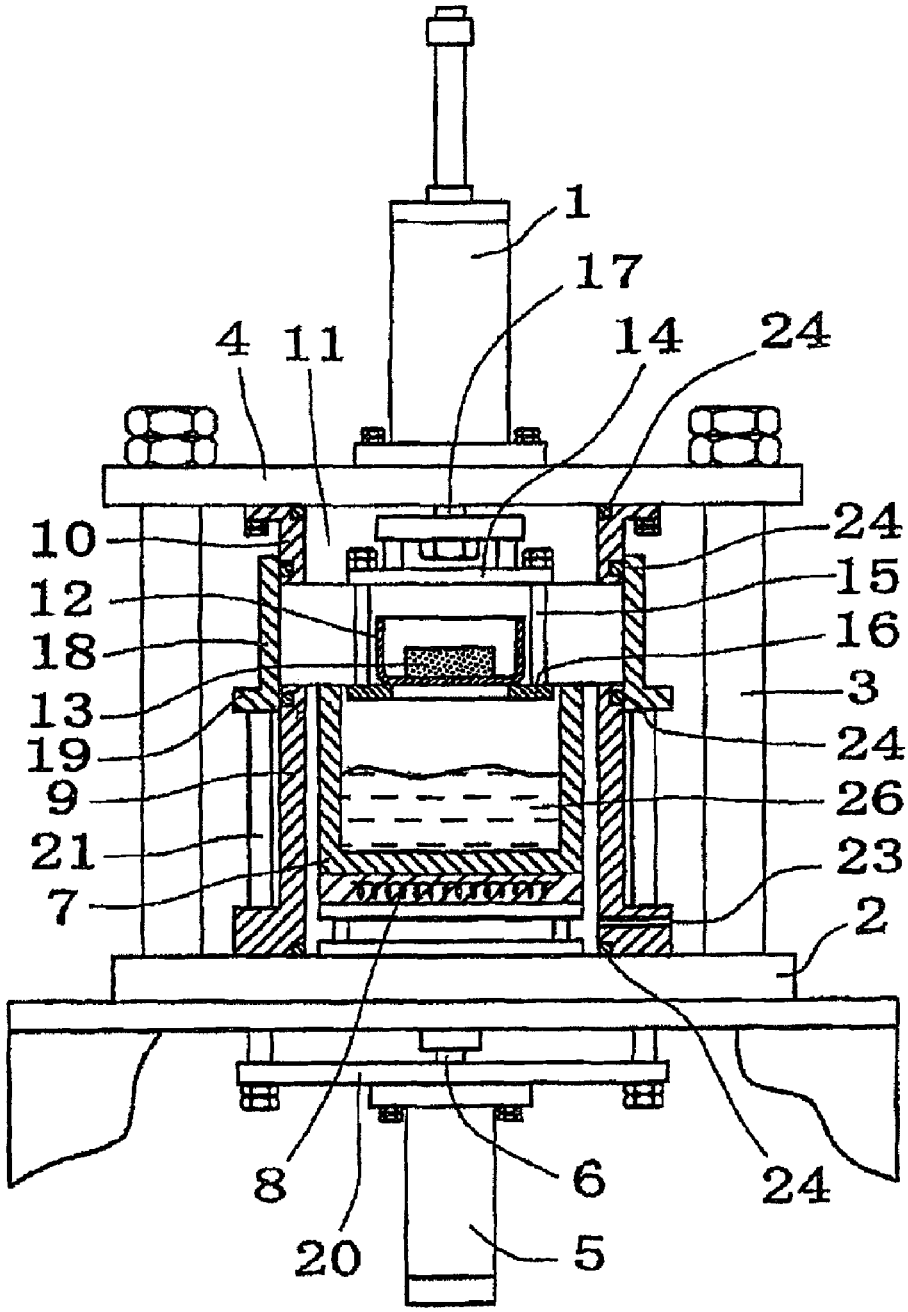
FIG. 2 is a front view schematically showing the deaerating state of the first embodiment of the vacuum/high pressure filling apparatus according to the present invention.
Figure 3:
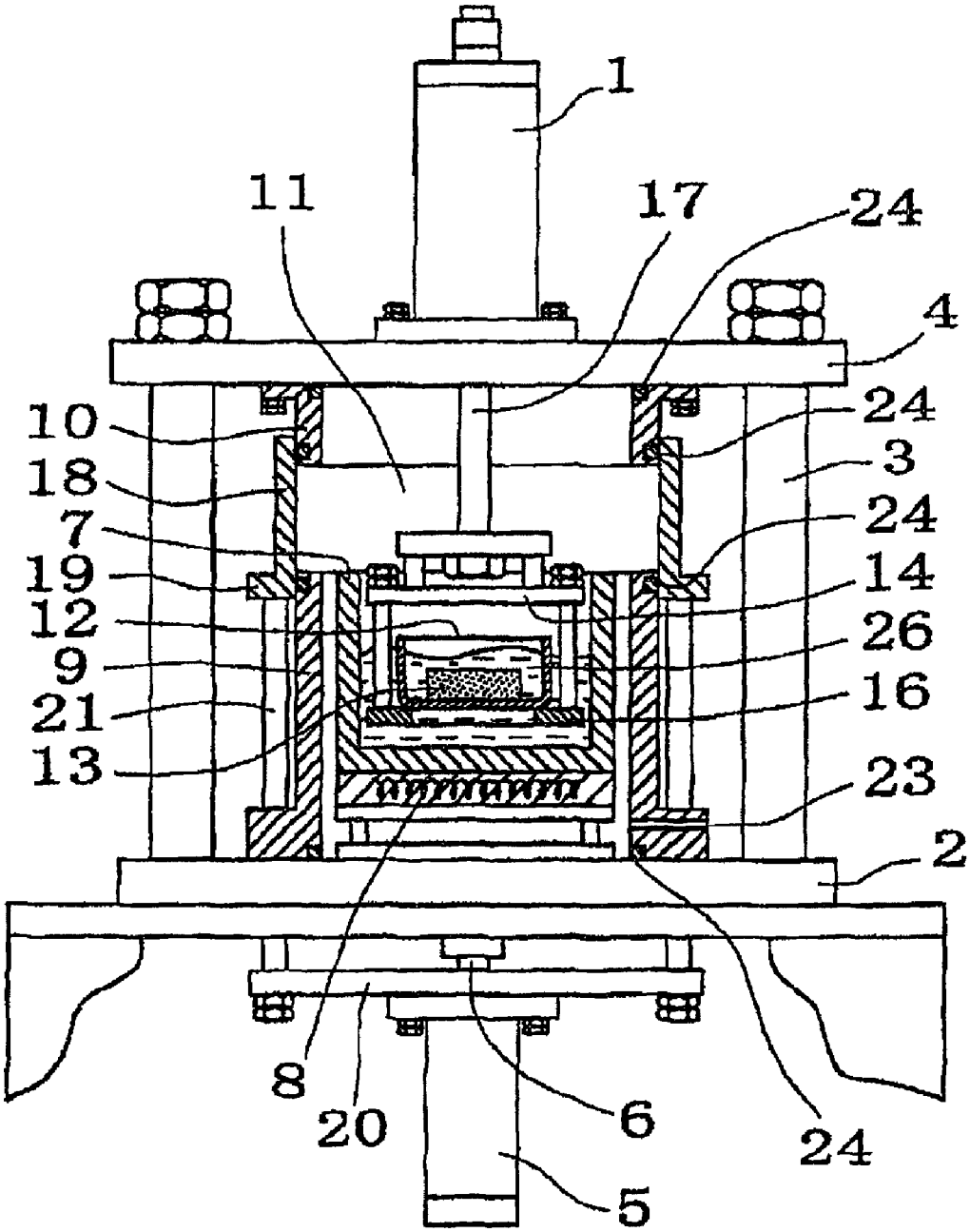
FIG. 3 is a front view schematically showing the pressure filling state of the first embodiment of the vacuum/high pressure filling apparatus according to the present invention.

FIGS. 1 to 3 show a first embodiment according to the present invention. FIG. 1 is a front view schematically showing a state in which a container for a workpiece to be processed can be moved in and out. FIG. 2 is a front view schematically showing a deaerating state. FIG. 3 is a front view schematically showing a pressure filling state. In FIGS. 1 to 3, a hang-down cylinder 1 is attached onto an attachment plate 4 which is horizontally provided over head portions of posts 3 erected at four corners of a base table 2, and a rod 17 extends downwardly through the attachment plate 4. On the other hand, a push-up cylinder 5 is upwardly attached on a lower side of the base table 2. The push-up cylinder 5 is coaxially arranged with the hang-down cylinder 1, and a leading end of its rod 6 is fixed to the lower face of the base table 2, so that the rod 6 is extended and shrunk to vertically move the push-up cylinder 5 itself. The push-up cylinder 5 ascends the below-mentioned sliding frame 18 so that the sliding frame 18 may be simultaneously and closely fitted to outer peripheral faces of a lower fixed frame 9 and an upper fixed frame 10, thereby forming a pressure-proof partition chamber unit 11 in which a space is defined by the base table 2, the attachment plate 4, the lower fixed frame 9, the upper fixed frame 10, and the sliding frame 18 and of which interior space can be sucked to vacuum and pressurized.

A liquid vessel 7 is fixed in a floated fashion on a bottom face of the above partition chamber unit 11, and a heater plate 8 is provided on or a heater-attached liquid vessel receiving table 8 is built in the bottom portion of the liquid vessel. The lower fixed frame 9 having a cylindrical form with a square shape (or a round shape) in plane is fixedly set up on the base table 2, while surrounding and spaced at a some interval outside the liquid vessel 7. The edge of the leading end of the lower fixed frame is positioned almost in the same level with or lower or upper than the position of the upper face of the liquid vessel 7.

The upper fixed frame 10 is fixedly hanged down from the lower face of the attachment plate 4, and the lower end face of the upper fixed frame 10 has a cylindrical shape with the shape and size in conformity with those of the upper end face of the above lower fixed frame 9 on the base table 2, respectively.

A workpiece container 12 is to immerse a porous workpiece 13 in the liquid vessel 7, and is place on an elevator table 16. The elevator table 16 is fixedly connected on a lower side of the rod 17 through a hang-down member 14 attached horizontally to the rod of the hang-down cylinder 1 and a plurality of connection rods 15. The workpiece container 12 is mounted on the elevator table 16, and vertically moved by the extension and the shrinkage of the rod 17 of the hang-down cylinder 1. The workpiece container 12 and the elevator table 16 are desirably constituted by a porous material such as a bored or grooved metallic material or a punched metal so that the liquid can readily enter therein. Ordinarily some porous workpieces 13 are placed in the workpiece container, piled one upon another, but a single porous workpiece may be installed or plural ones may be arranged in rows.

The cylindrical sliding frame 18 is closely and vertically slidably fitted around the outer peripheral face of the lower fixed frame 9, and the sliding frame 18 is vertically moved by driving the push-up cylinder 5 under the base table 2. That is, as shown for example, the sliding frame body 18 is formed with an outward flange 19 around the outer lower periphery thereof, and the outward flange 19 is fixedly connected to a push-up plate 20 horizontally attached to the push-up cylinder 5 through plural connection rods 21 passing the base table 2 and a base portion 9*a* at a lower end of the lower fixed frame. Thus, the sliding frame 18 is vertically moved together with the cylinder 5 by expanding and shrinking the rod 6 of the cylinder 5.

A vacuum suction opening 23 is formed at a part of the lower fixed frame 9, and connected to a vacuum pump (not shown). When the partition chamber unit 11 is formed, air is sucked from the interior of the partition chamber unit 11 through the vacuum suction opening 23, thereby forming the partition chamber unit 11 with high vacuum degree. The vacuum suction opening 23 is not necessarily provided in the lower fixed frame 9, but it may be provided in the base table 2, the attachment plate 4 or the upper fixed frame 10 constituting the partition chamber unit In order to enhance the gastightness of the partition chamber unit 11, seal packings 24 such as O-rings are provided at contact faces between the lower fixed frame 9 and the base table 2 and between the upper fixed frame 10 and the attachment plate 4 and the sliding face of the sliding frame 18.

Thus, according to the first embodiment of the vacuum/high pressure filling apparatus, an appropriate amount of the filling liquid 26 is first placed in the liquid vessel 7, and the porous workpiece 13 to be processed is installed in the workpiece container 12 and the container is placed on the elevator table 16. The sliding frame 18 is slidably ascended along the outer peripheral face of the lower fixed frame 9 through the connection rods 21 by retracting the rod 6 of the push-up cylinder 5 on the lower side, the upper portion of the sliding frame body 18 is brought into contact with the outer peripheral face of the upper fixed frame 10, and the sliding frame 18 forms a complete closure between the upper and lower fixed frames 9 and 10. Thereby, the partition chamber unit 11 is formed and surrounded by the attachment plate 4, the lower base table 2, the upper and lower fixed frames 9 and 10 and the sliding frame 18.

In this case, the interior of the partition chamber unit 11 is sucked to vacuum by vacuum sucking with the vacuum pump (not shown) through the vacuum suction opening 23, so that a high vacuum state is realized in the partition chamber unit 11 being sucked to vacuum and pores in the porous workpiece 13 to be processed are deaerated.

As mentioned above, after the pores of the porous workpiece 13 is completely deaerated, the vacuum sucking through the suction opening 23 is stopped, and the workpiece vessel 12 and the elevator table 16 are descended and immersed in the filling liquid 26 inside the liquid vessel 7 by extending the rod 17 of the hand-down cylinder 1.

After the immersion, air or the mixing gas is introduced through the vacuum suction opening 23 to set the interior of the partition chamber unit 11 to high pressure and pressurize the filling liquid 26. This pressurization forcedly fills the pores of the porous workpiece 13 with the filling liquid 26. According to this embodiment, the vacuum suction opening 23 also serves as the pressurizing opening to set the interior of the partition chamber unit to high pressure state, but they may be separately provided.

After the introduction of air or the mixing gas is stopped, following the forcedly filling, the rod 6 of the push-up cylinder 5 is extended to descend the sliding frame 18, the sliding frame 18 is left from the upper fixed frame 10, and the interior of the partition chamber unit 11 is returned to the atmospheric pressure. Also, by shrinking the rod 17 of the hang-down cylinder 1, the workpiece vessel 12 and the elevator table 16 are ascended and pulled up from the filling liquid 26 in the liquid vessel 7. Then, a worker takes out the workpiece vessel 12, thereby completing the process.

Therefore, according to the vacuum/high pressure filling apparatus of the above first embodiment, the composite material product which is imparted with improved electroconductivity, insulation property, magnetizable property, shielding property, lubricity, antibacterial property, corrosion resistance, rigidity, seal performance, earthquake resistance, etc. can be effectively produced by filling (penetrating, impregnating) the pores of the porous workpiece with the filling liquid.

In this case, after the porous workpiece is deaerated and waited in vacuum, the workpiece can be filled instantly or in a short time in case that the filling liquid is not viscous, whereas in case that the filling liquid is viscous, it can be forcedly filled into the workpiece under application of high pressure. Consequently, the filling rate can be increased and the impregnation filling time period can be shortened. In addition, since the filling liquid needs not be moved unlike the conventional case, the working time period can be largely shortened.

Further, the present invention can be practiced by the construction that a liquid feed opening and an liquid exhaust opening are provided in the attachment plate 4 and the liquid vessel 7, and the liquid inside the liquid vessel 7 is supplemented or exchanged as needed.

Moreover, the metal can be non-electrolytically plated in the first embodiment. The interior of the partition chamber unit 11 is evacuated, the pores existing in the porous workpiece 50 inside the workpiece container 53 are deaerated, the workpiece is immersed in the plating liquid inside the liquid vessel 7 in this deaerated state, and a chemical reaction between the plating liquid and metallic surfaces of the porous pore portions spreads inside the pores upon receipt of pressure with the gas. Thereby, an intermetallic compound can be advantageously obtained free from defects at the inner faces of the pores.

Second Embodiment

Figure 4:
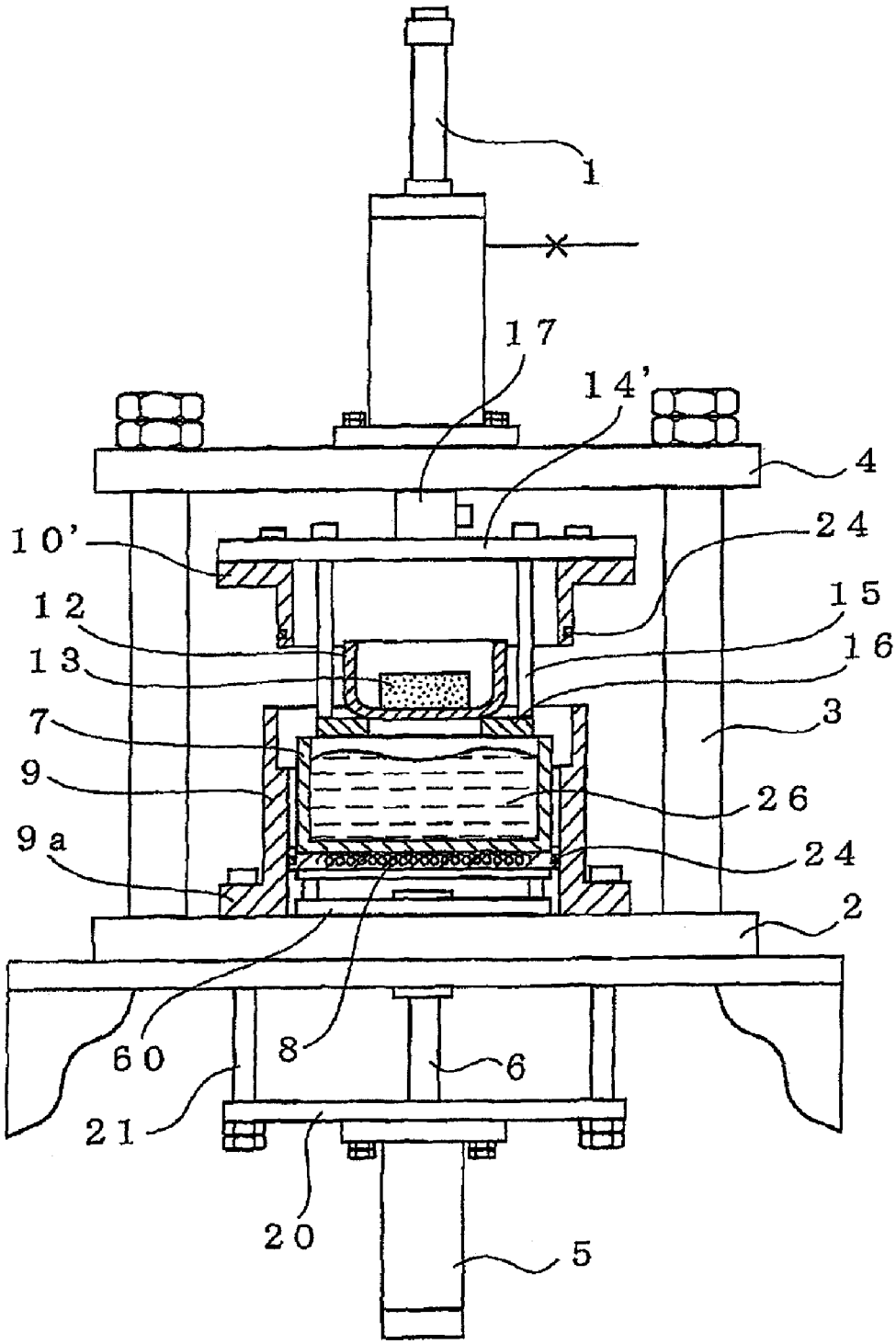
FIG. 4 is a front view schematically showing a second embodiment of the vacuum/high pressure filling apparatus according to the present invention.

A second embodiment will be explained based on FIG. 4. The second embodiment is the same as the first one except for the following points.

A hang-down member 14' is attached to a lower end portion of a rod 17 of a hang-down cylinder 1, and an elevator table 16 is fixedly connected to a lower face of the hang-down member 14' through plural connection rods 15. An upper frame 10' is hung down from a attachment plate, surrounding the outer side of the connection rods 15. As shown in FIG. 4, an upper end portion of a lower moving frame 9 and a lower end portion of the upper frame 10' are designed to be closely engaged with each other. A liquid vessel 7 is fixed, in a floated manner, to a liquid vessel receiving table 8 equipped with a heater, and the lower moving frame 9 is arranged along the outer periphery of the liquid vessel receiving table 8. An outer flange 19 of the lower moving frame is fixedly connected to a push-up plate 20 of a push-up cylinder 5 via plural connection rods 21, and the lower moving frame 18 is vertically moved together with the cylinder 5 by extending or shrinking the rod 6 of the cylinder 5. Gastightness is secured between the liquid vessel receiving table 8 and the lower moving frame 18 via a seal packing 24 such as an O ring at the outer periphery of the liquid vessel receiving table 8. In this way, the sliding frame 18 is ascended to contact the upper moving frame 10' through extension/shrinkage of the cylinder 5, and gastightness is held via the seal packing 24 of the upper moving frame. Thus, a partition chamber unit 11 is formed. The way of forming this partition chamber 11 can be applied also for the fixed frame in FIG. 1 besides the upper moving frame in FIG. 4.

According to this embodiment, the rod 17 of the hang-down cylinder 1 is extended and locked on the way, the rod 6 of the push-up cylinder 5 is shrunk to ascend the lower moving frame, and thereby the lower end portion of the upper moving frame is hermetically contacted with the upper end portion of the lower moving frame to form the partition chamber 11. Thereafter, the inside of the partition chamber is sucked to vacuum, and then the workpiece is immersed into the filling liquid 26 in the liquid vessel 7 by further pushing down the rod of the hang-down cylinder 1. The interior of the partition chamber is pressurized to perform a desired impregnation processing for the workpiece. Then, the rod 17 of the hang-down cylinder 1 is shrunk to open the partition chamber unit, the processed workpiece is pulled up from the filling liquid, the rod 6 of the push-up cylinder 5 is extended, and the processed workpiece is taken out of the opened partition chamber unit.

Third Embodiment

Figure 5:
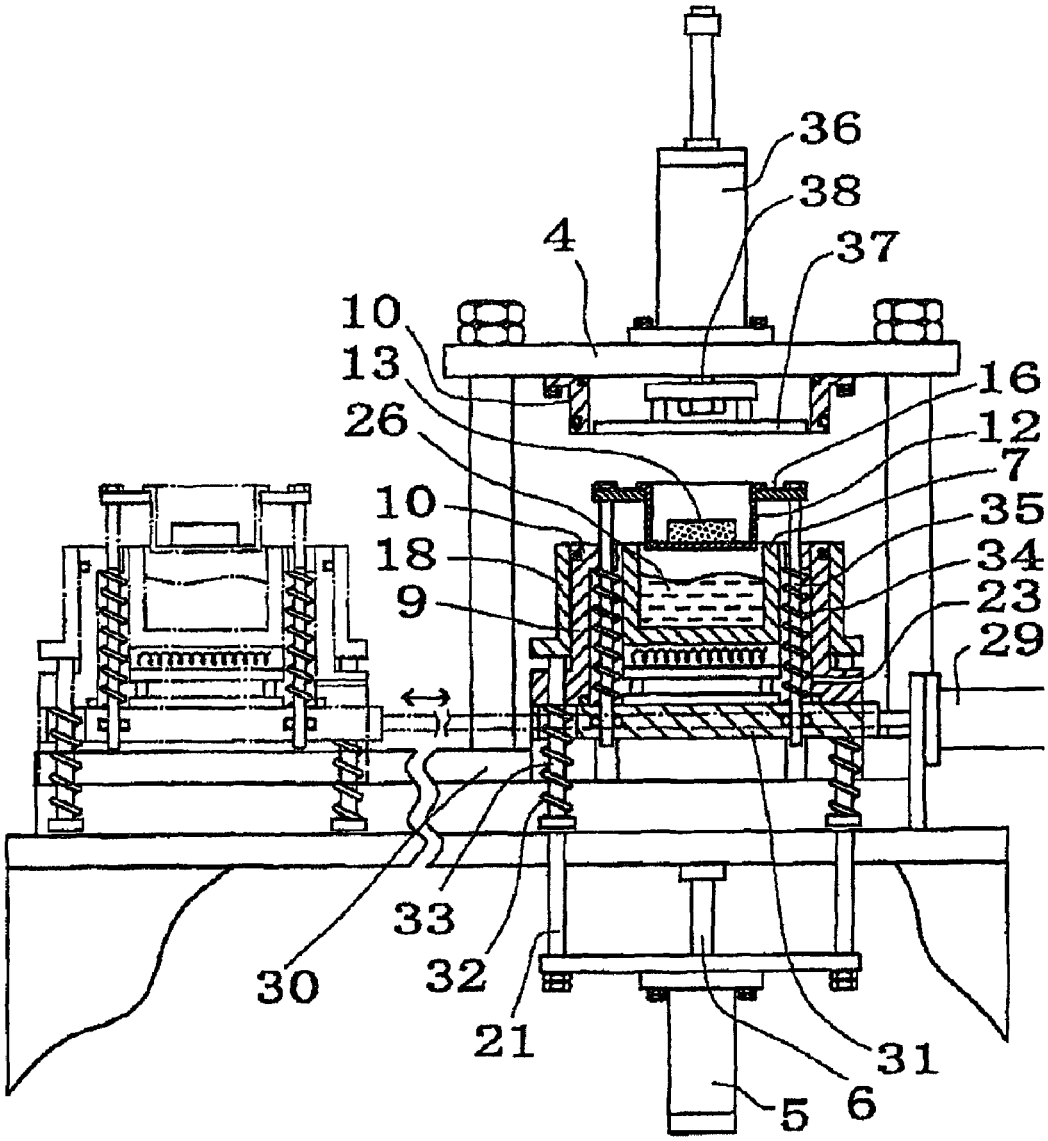
FIG. 5 is a front view schematically showing a third embodiment of the vacuum/high pressure filling apparatus according to the present invention.

FIG. 5 is a front view schematically showing a third embodiment in which automatization is performed by using a slide table.

That is, a workpiece container is designed as an automated transportation system, so that the porous workpiece can be moved in and out from the workpiece container outside the machine. Specifically, a slide table 31 (corresponding to the base table 2), which is slid on a rail 30 by means of a slide cylinder 29, is used, the lower fixed frame 10, the sliding frame 18, the liquid vessel 7, the workpiece container 12 and the elevator table 16 are reciprocated laterally, and the slide frame 18 is vertically moved via intermediate transmission rods 33 which are to be returned downwardly by return springs 32, and the elevator table 16 is ascended via leg rods 35 which are returned upwardly by return springs 34. Further, the elevator table 16 is moved downwardly by a push plate 37 which is vertically moved by a push up-and-down cylinder 36. However, the sliding frame 18 and the elevator table 16 are each vertically moved not by the return springs but by the provision of a built-in cylinder or the like.

Then, as shown in FIG. 5 by virtual lines, the slide table 31 (base plate 2) is first moved to left in this figure, and the lower fixed frame 10, the sliding frame 18, the liquid vessel 7, the workpiece container 12 and the elevator table 16 are laterally taken out. In this position, the filling liquid 26 is put in an appropriate amount into the liquid vessel 7, and the porous workpiece 13 to be processed is placed in the workpiece container 12 for standby. Then, the slide table 31 is returned to the right in this figure, and the lower fixed frame 10, the sliding frame 18, the liquid vessel 7, the workpiece container 12 and the elevator table 16 are returned to their original positions. In this state, the rod 6 of the push-up cylinder 5 on the under side is pulled in the same manner as in the first embodiment, so that the sliding frame 18 is ascended via the connection rods 21 and the intermediate transmission rods 33, while being slid along the outer peripheral face of the lower fixed frame 9. Then, an upper portion of the sliding frame is contacted with the outer peripheral face (or the lower end face) of the upper fixed frame 10, and closure is effected between both the upper and lower fixed frames 9 and 10 by means of the sliding frame 18. Thereby, the pressure-proof partition chamber unit 11 is formed and surrounded by the attachment plate 4, the lower slide table 31 (base table 2), both the upper and lower fixed frames 9 and 10 and the sliding frame 18. In this state, the interior of the partition chamber unit is sucked to vacuum by the vacuum pump (not shown) through the vacuum suction opening 23. When the interior of the partition chamber unit is sucked to vacuum, it reaches a high vacuum degree and the pores in the porous workpiece 13 to be processed are deaerated.

After the pores of the workpiece 13 are completely deaerated in the above manner, vacuum suction through the suction opening 23 is stopped, and the rod 38 of the push-down cylinder 36 is extended to descend the workpiece container 12 and the elevator table 16 and immerse them into the filling liquid 26 inside the liquid vessel 7. After the immersion, air or the mixing gas is introduce through the vacuum suction opening 23 to attain high pressure inside the partition chamber unit 11 and pressurize the filling liquid 26. This pressurization forcedly fills the filling liquid 26 into the pores in the porous workpiece 13.

After this forced filling, the introduction of air or the mixing gas is stopped, and the rod 6 of the push-up cylinder 5 is extended to descend the sliding frame 18. While the interior of the partition chamber unit is being returned to the atmospheric pressure, the sliding frame 18 is moved away from the upper fixed frame 10. The rod 38 of the push-down cylinder 36 is shrunk to ascend the workpiece container 12 and the elevator table 16 and pull up them from the filling liquid 26 in the liquid vessel 7. After the pull-up step, the slide table 31 is moved to the above left side again, the slide table 31 (base table 2), the lower fixed frame 10, the sliding frame 18, the liquid vessel 7, the workpiece container 12 and the elevator table 16 are moved or put out laterally. In this position, a worker takes out the porous workpiece having completely undergone the forced filling from the workpiece container 12, thereby terminating the process. Then, when an working operation is to be continued thereafter, it may be that a new porous workpiece 13 to be processed is placed in the empty workpiece container 12, and the steps are continuously repeated.

Therefore, according to the vacuum/high pressure filling apparatus of the above third embodiment, since the workpiece container in which the porous workpiece is placed is mounted on the slide table and is then automatically transported, the productivity can be raised, and full atomization or semi-atomization can be realized.

According to the vacuum/high pressure filling apparatuses of the first, second and third embodiments, a heating unit, a cooling unit, a vibrating unit, an oscillating unit, a stirring rotor and/or an ultraviolet ray irradiator can be provided as needed at an appropriate location to heat, cool, vibrate, oscillate, stir and/or irradiate ultraviolet rays upon the porous workpiece and the filling liquid 26 inside the liquid vessel during immersing and pressurizing so as to enhance the filling rate, shorten the filling time and effectively perform sterilization.

Further, according to the vacuum/high pressure filling apparatus of the above third embodiment, the portion to be reciprocated by the slide table 31, that is, the portion including the lower fixed frame 10, the sliding frame 18, the liquid vessel 7, the workpiece vessel 12 and the elevator table 16 is designed as a unit to be commonly used, so that the unit can be arbitrarily exchanged and used as a cartridge system. According to this system, for example, when the unit is arbitrarily exchanged, particular kinds of vacuum/high pressure filled products having undergone filling (impregnation, mix penetration) with particular filling materials can be easily obtained. In order to prepare a next working, another unit of a workpiece container in which a workpiece is placed can be preliminarily made up, or another liquid vessel in which the filler is put can be preliminarily made up. Consequently, the working procedure for coping with multiple kinds of products can be simplified, and preparation time periods on working can be shortened.

Fourth Embodiment

Figure 6:
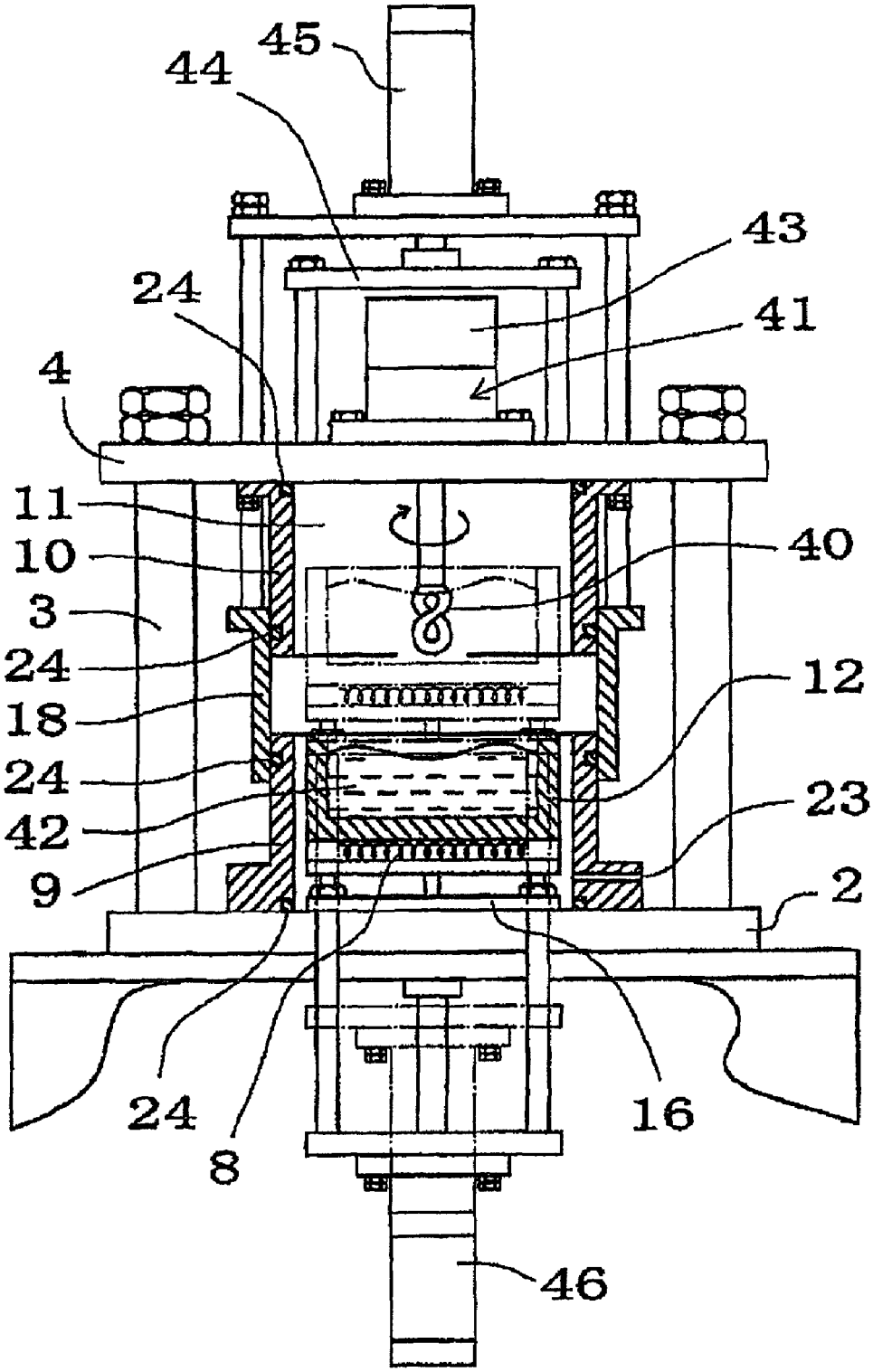
FIG. 6 is a front view schematically showing a fourth embodiment of the vacuum/high pressure filling apparatus according to the present invention.

FIG. 6 is a front view schematically showing a fourth embodiment additionally provided with a stirring function.

That is, since this embodiment is additionally provided with a stirring function, the filling rate and a chemical reaction of the mixing gas are enhanced (the time period is shortened), and the filling concentration of the mixing gas is increased. Specifically, the fourth embodiment comprises an openable and closable pressure-proof partition chamber unit 11, a vacuum suction opening 23 for evacuating the partition chamber unit 11, a gas feed opening (for which the above vacuum suction opening 23 is also used) for charging a mixing gas such as oxygen, hydrogen, nitrogen, argon, other mix gas a modified gas or a reactive gas into the evacuated partition unit 11, a stirrer 41 arranged in an upper portion of the partition chamber unit 11 such that a rotary element 40 is located in the upper portion of the partition chamber unit 11, and an elevator table 16 for vertically moving a material container 12 for a fluid material to be processed, with respect to the stirring rotary element 40.

The partition chamber unit 11 is first opened, the material container 12 in which the fluid material 42 to be processed is placed on the elevator table 16, and the partition chamber unit 11 is closed. Then, the interior of the partition chamber unit 11 is evacuated to form a pressure-proof vacuum partition chamber unit and to deaerate air from the fluid material 42 to be processed. The stirring rotary element 40 of the stirrer 41 is immersed into the deaerated fluid material 42 by ascending the elevator table 16, and the mixing gas such as oxygen, hydrogen, nitrogen, argon, other mix gas, the modified gas or the reactive gas is filled into the evacuated partition chamber unit 11 at a high pressure. Thereafter, the stirring rotary element 40 is actuated for a given time period, and then stirring is stopped by descending the elevator table 16. After that, the partition chamber unit 11 is opened, and the mixing gas-mixed fluid material is taken out from the partition chamber 11. The stirring rotary element 40 is rotated by the reduction gear stirrer 41 and a rotary motor 43. The sliding frame 18 of the partition chamber unit 11 is vertically moved by a cylinder 45 installed on the attachment plate 4 via a mounting table 44. The elevator table 16 of the material container 12 is vertically moved by a cylinder 46 arranged under the base table 2. According to this fourth embodiment, the same reference numbers are given to the same portions as in the above first embodiment, and explanation thereof is omitted.

Therefore, according to the vacuum/high pressure filling apparatus of the above fourth embodiment, the reaction with the gas can be promoted (the time period is shortened), and the concentration of the gas entrained can be increased.

Fifth Embodiment

Figure 7:
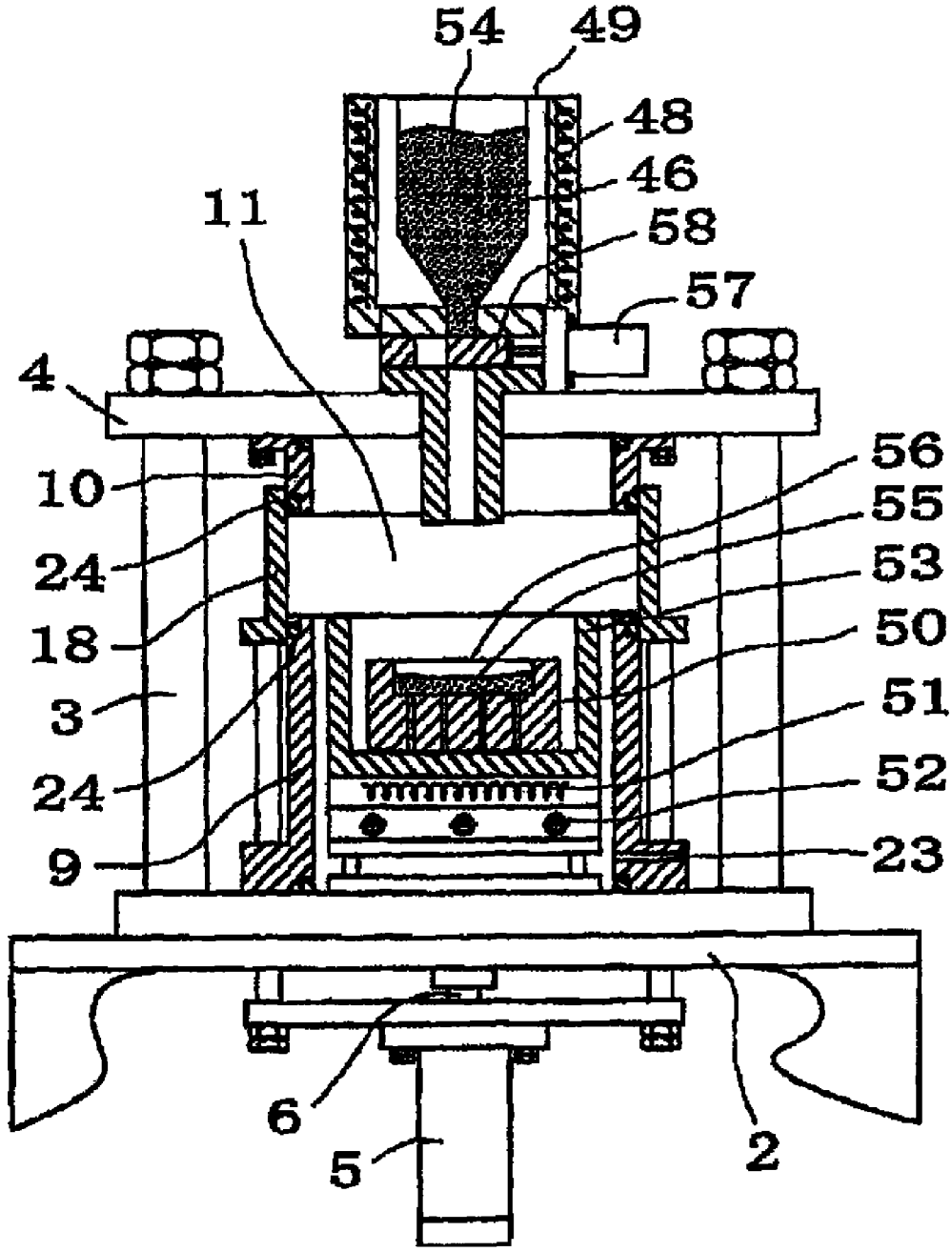
FIG. 7 is a front view schematically showing a fifth embodiment of the vacuum/high pressure filling apparatus according to the present invention.
Figure 8:
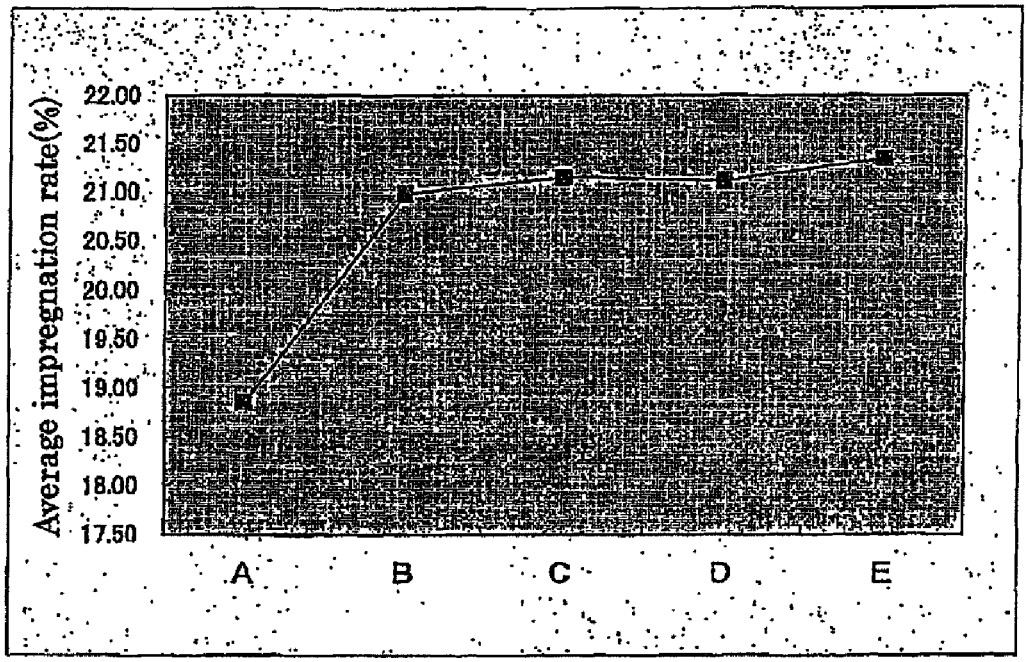
FIG. 8 shows test results in cases where a vacuum/high pressure filling apparatus according to the present invention or a conventional immersion type filling apparatus was used.

FIG. 7 is a front view schematically showing a fifth embodiment added with a melting furnace 49 having a heating heater 48 so as to feed a melt. In this embodiment, a case where a safety valve for a high pressure gas cylinder to escape a gas pressure under firing is produced will be explained, for example.

That is, since the melting furnace 49 is added with the heating heater 48 to feed the melt 54, the metal melt can be finely filled in pores or cavities of a porous workpiece 50 of such as ceramics, a metal or a cast metal (casting mold). Specifically, the fifth embodiment comprises an openable and closable partition chamber unit 11, a vacuum suction opening 23 to evacuate the partition chamber unit 11, a pressurizing opening (for which the above vacuum suction opening 23 is also used) for set the interior of the partition chamber unit 11 to high pressure, a workpiece vessel 53 arranged in the partition chamber unit 11 which is adapted to receive a porous workpiece 50 (for example, a safety valve member for a high pressure gas cylinder) and is equipped with a heating heater 51 and a cooling water cooler 52, and a furnace 49 which is arranged above the partition chamber unit 11 and adapted to feed a melt 54. The melting furnace 49 is opened and closed by a shutter 58, which is reciprocated by means of a cylinder 57. A valve or other opening and closing tool may be used instead of the shutter.

The partition chamber unit 11 is first opened, the porous workpiece 50 is placed in the workpiece container 53, and the partition chamber unit 11 is closed. Then, the interior of the partition chamber unit 11 is evacuated to form the pressure-proof vacuum chamber unit and thereby deaerated pores existing in the porous workpieces 50 inside the workpiece container 53. In the deaerated state, the metal melt 54 is fed from the melting furnace 49 with the heating function to fill the melt 54 in the pores or cavities. Then, nitrogen, argon gas or the like is introduced into the partition chamber unit 11 to set the chamber interior to high pressure, so that the melt is filled in the pores under application of high pressure onto the fed melt 55. Thereafter, the partition chamber unit 11 is opened and returned to the atmospheric pressure, and the porous workpiece 50 inside the workpiece container 53 is taken out from the partition chamber unit 11. When a wide melt-feeding face for a melt stay 56 is provided in a melt-feeding portion of the porous workpiece 55, pressure is more effectively applied to the fed melt 55. Further, a bottom portion of the porous workpiece is hermetically disposed on the workpiece container. The fifth embodiment is provided with the same reference numbers on the same portions as in the first embodiment, and explanation thereof is omitted.

Therefore, according to the vacuum/high pressure filling apparatus of the above fifth embodiment, casting can be effectively performed in vacuum by pouring the melt in the cast mold arranged in the vacuum partition chamber unit. When the melt is poured and stopped in vacuum in the same manner as above and pressure is applied to the wide melt staying face, and fine casting can be performed, while securing the good flow of the melt in a non-oxidizing state.

(Experiments)

A conventional impregnation tank type vacuum filling apparatus with a lid and the vacuum/high pressure filling apparatus according to the present invention as shown in FIGS. 1 to 3 were used. Ten of copper alloy bearings each having an outer diameter of 9.8 mm×an inner diameter of 3 mm×a height of 7 mm as porous workpieces were impregnated with a lubricant one by one, and measurements were carried out by weighing for the comparison purpose. It was seen from the results that the impregnating rate and the immersion/impregnation time period were both greatly improved as compared with the immersion/deaerating system in the prior art. The oil contents were measured, and their average value was obtained.

A: Conventional lid-provided impregnation tank type vacuum filling apparatus

After the workpiece was immersed at a vacuum degree of 10 kPa for 30 minutes, and kept at ordinary pressure for 5 minutes.

B-D: Vacuum/high pressure filling apparatus shown in FIGS. 1 to 3 according to the present invention B: Held at a vacuum degree of 1 kPa for one minute and immersed at pressure of 1 MPa for 2 minutes.

C: Held at a vacuum degree of 1 kPa for 2 minutes and immersed at pressure of 1 MPa for 4 minutes.

D: Held at a vacuum degree of 1 kPa for 3 minutes and immersed at pressure of 1 MPa for 7 minutes.

E: Held at a vacuum degree of 1 kPa for 5 minutes and immersed at pressure of 1 MPa for 10 minutes.

Results are shown below.

| Impregnating condition | Average impregnation rate (%) |
|---|---|
| A | 18.856 |
| B | 20.983 |
| C | 21.149 |
| D | 21.111 |
| E | 21.340 |

It is seen from the above results that the oil contents could be largely increased as compared with the conventional lid-provided immersing tank type vacuum filling apparatus.

INDUSTRIAL APPLICABILITY

According to the vacuum/high pressure filling apparatus, the composite materials such as the oil-impregnated metals and the composite products such as the gas safety valves in which the filling liquid, the melt or the like is filled in the pores of the porous workpiece at a high filling rate can be obtained. The fluid composite products and the fluid modified liquid products can be obtained by mixing the mixing gas into the fluid material to be processed or performing the chemical reaction with the entrained mixing gas.

What is claimed is:

1. A vacuum/high pressure filling apparatus comprising: a base table, a lower fixed frame arranged on the base table, an upper frame fixed to a lower face of an attachment plate installed above the base table, a hermetically sliding mechanism adapted to secure gastightness between the lower fixed frame and the upper frame, and a sliding drive mechanism to drive the hermetically sliding mechanism, the hermetically sliding mechanism comprising a sliding frame which is vertically slidably fitted around the outer circumferential face of either one of the lower fixed frame and the upper frame and which vertically moves and slidably closely contacts the outer circumference of the other while the upper frame and lower fixed frame are held in a fixed position, so that gastightness is ensured among the lower fixed frame, the sliding frame and the upper frame by sliding the sliding frame with the sliding drive mechanism, wherein a hermetic partition chamber unit is formed by the base table, the lower fixed frame, the upper frame, the attachment plate and the sliding frame by driving the sliding frame with the sliding drive mechanism, the vacuum/high pressure filling apparatus further comprising a vacuum suction opening provided for the hermetic partition chamber unit to evacuate the hermetic partition chamber unit to vacuum, a pressurizing opening provided for the hermetic partition chamber unit to set the interior of the hermetic partition chamber unit to a high pressure state with a high pressure gas, a liquid vessel arranged on the base table and in an inner side of the lower fixed frame and adapted to receive a filling liquid, a holder arranged in the hermetic partition chamber unit for a porous workpiece to be processed, and an elevator unit adapted to move the filling liquid in the liquid vessel and the porous workpiece holder relative to each other inside the hermetic partition chamber unit to immerse the porous workpiece into the filling liquid in the liquid vessel and pulls up the workpiece from the filling liquid, wherein, the porous workpiece is held above the filing liquid by the holder, the hermetic partition chamber unit is formed, the porous workpiece is degassed through evacuating the interior of the hermetic partition chamber unit to vacuum through the vacuum suction opening, the porous workpiece is immersed into the filling liquid, the hermetic partition chamber unit is set to a high pressure state by introducing the high pressure gas thereinto through the pressurizing opening, the filling liquid is impregnated into the porous workpiece by applying the high pressure upon the upper surface of the filling liquid inside the liquid vessel, the impregnated workpiece is pulled up from the filling liquid, the hermetic partition chamber unit is opened, and the impregnated workpiece is taken outside.

2. The vacuum/high pressure filling apparatus set forth in claim 1, which further comprises a heating unit, cooling unit, a vibrating unit, an oscillating unit, a stirring rotor or an ultraviolet ray irradiator to heat, cool, vibrate, oscillate, stir or irradiate ultraviolet rays upon the filling liquid in the liquid vessel.

3. The vacuum/high pressure filling apparatus set forth in claim 1, which comprises a slide table adapted to put the liquid vessel into and out of the partition unit.

4. A vacuum/high pressure filling apparatus comprises: a base table, a lower fixed frame arranged on the base table, an upper frame fixed to a lower face of an attachment plate installed above the base table, a hermetically sliding mechanism adapted to secure gastightness between the lower fixed frame and the upper frame, and a sliding drive mechanism to drive the hermetically sliding mechanism, the hermetically sliding mechanism comprising a sliding frame which is vertically slidably fitted around the outer circumferential face of either one of the lower fixed frame and the upper frame and which vertically moves and slidably closely contacts the outer circumference of the other while the upper frame and lower fixed frame are held in a fixed position, so that gastightness is ensured among the lower fixed frame, the sliding frame and the upper frame by sliding the sliding frame with the sliding drive mechanism, wherein a hermetic partition chamber unit is formed by the base table, the lower fixed frame, the upper frame, the attachment plate and the sliding frame by driving the sliding frame with the sliding drive mechanism, the vacuum/high pressure filling apparatus further comprising a vacuum suction opening provided for the hermetic partition chamber unit to evacuate the hermetic partition chamber unit to vacuum, a pressurizing opening provided for the hermetic partition chamber unit to fill the interior of the hermetic partition chamber unit to a high pressure state with a mixing gas, a liquid vessel arranged on the base table in an inner side of the lower fixed frame and adapted to receive a fluid material to be treated, and a stirrer arranged in the hermetic partition chamber unit and adapted to stir the fluid material in the liquid vessel and mix the a mixing gas into the fluid material, wherein the fluid material to be treated is filled in the liquid vessel, the hermetical partition chamber unit is formed, the fluid material is degassed by evacuating the interior of the hermetic partition chamber unit to vacuum through the vacuum suction opening, the interior of the hermetic partition chamber unit is set at the high pressure state by introducing the mixing gas into the hermetic partition chamber unit at a high pressure through the pressurizing opening, the mixing gas is mixed into the fluid material inside the liquid vessel by stirring it under the high pressure, and the hermetic partition chamber unit is opened, and the treated fluid material is taken outside.

5. The vacuum/high pressure filling apparatus set forth in claim 4, wherein the stirrer comprises a stirring rotary element, and the stirrer is arranged such that the stirring rotary element is positioned in an upper portion of the hermetic partition chamber unit, said filling apparatus comprising an elevator adapted to vertically move the stirring rotary element and the liquid vessel for the fluid material relative to each other to immerse the stirring rotary element into the fluid material to be processed in the liquid vessel and pull up the stirring rotary element from the fluid material.

6. The vacuum/high pressure filling apparatus set forth in claim 4, which further comprises a heating unit, cooling unit, a vibrating unit, an oscillating unit or an ultraviolet ray irradiator to heat, cool, vibrate, oscillate, or irradiate ultraviolet rays upon the filling liquid in the liquid vessel.

7. The vacuum/high pressure filling apparatus set forth claims 4, which comprises a slide table adapted to put the liquid vessel into and out of the machine.

8. A vacuum/high pressure filling apparatus, which comprises a base table, a lower fixed frame arranged on the base table, an upper frame fixed to a lower face of an attachment plate installed above the base table, a hermetically sliding mechanism adapted to secure gastightness between the lower fixed frame and the upper frame, and a sliding drive mechanism to drive the hermetically sliding mechanism, the sliding drive mechanism comprising a sliding frame which is vertically slidably fitted around the outer circumferential face of either one of the lower fixed frame and the upper frame and which vertically moves and slidably closely contacts the outer circumference of the other while the upper frame and lower fixed frame are held in a fixed position, so that gastightness is ensured among the lower fixed frame, the sliding frame and the upper frame by sliding the sliding frame with the hermetically sliding mechanism, wherein a hermetic partition chamber unit is formed by the base table, the lower fixed frame, the upper frame, the attachment plate and the sliding frame by driving the sliding frame with the sliding drive mechanism, a vacuum suction opening provided for the hermetic partition chamber unit to evacuate the hermetic partition chamber unit to vacuum, a pressurizing opening provided for the hermetic partition chamber unit to set the interior of the hermetic partition chamber unit to a high pressure state with an inert gas, a porous workpiece container arranged in an inner side of the lower fixed frame, adapted to receive a porous workpiece to be processed and equipped with a heating mechanism and a cooling mechanism, and a melting furnace adapted to feed a melt to the porous workpiece received in the container inside the hermetic partition chamber unit, the melting furnace being equipped with a heating function, wherein the porous workpiece is received in the porous workpiece container, the hermetic partition chamber unit is formed, the porous workpiece is degassed by evacuating the interior of the hermetic partition chamber unit to vacuum through the vacuum suction opening, the melt is fed to the porous workpiece received in the container, the interior of the hermetic partition chamber unit is set to the high pressure state by introducing the inert gas thereinto through the pressurizing opening, the melt is impregnated into the porous workpiece by applying a high pressure upon the melt fed to the porous workpiece received in the container, the hermetic partition chamber unit is opened, and the impregnated workpiece is taken outside.

9. The vacuum/high pressure filling apparatus set forth in claim 8, which comprises a vibrating unit or an oscillating unit to vibrate or oscillate the porous workpiece during feeding the melt.

10. The vacuum/high pressure filling apparatus set forth in claim 8, which comprises a slide table adapted to move the porous workpiece container in or out of the machine.

11. The vacuum/high pressure filling apparatus set forth in claim 2, which comprises a slide table adapted to put the liquid vessel into and out of the partition unit.

12. The vacuum/high pressure filling apparatus set forth in claim 5, which further comprises a heating unit, cooling unit, a vibrating unit, an oscillating unit or an ultraviolet ray irradiator to heat, cool, vibrate, oscillate, or irradiate ultraviolet rays upon the filling liquid in the liquid vessel.

13. The vacuum/high pressure filling apparatus set forth in claim 5, which comprises a slide table adapted to move the liquid vessel in and out of the machine.

14. The vacuum/high pressure filling apparatus set forth in claim 6, which comprises a slide table adapted to move the liquid vessel in and out of the machine.

15. The vacuum/high pressure filling apparatus set forth in claim 9, which comprises a slide table adapted to put the porous workpiece container into or out of the machine.

* * * * *